United States Patent [19]

Wyatt

[11] Patent Number: 4,669,232

[45] Date of Patent: Jun. 2, 1987

[54] RAIN GUTTER SUPPORTS FOR DUMPING DEBRIS

[76] Inventor: Robert L. Wyatt, 22717 149th Ave. East, Graham, Wash. 98338

[21] Appl. No.: 781,263

[22] Filed: Sep. 27, 1985

[51] Int. Cl.[4] ..... E04D 13/00

[52] U.S. Cl. ..... 52/11; 52/12; 294/19.1; 16/389

[58] Field of Search ..... 52/11, 12, 16, 14, 15, 52/13; 248/48.1, 48.2; 16/223, 242, 239, 324, 333, 335, 347, 349, 355, 356, 387, 389, 390, 391, 392; 294/19.1, 24

[56] References Cited

U.S. PATENT DOCUMENTS

| | | | |
|---|---|---|---|
| 1,512,315 | 10/1924 | Sandford | 294/24 |
| 3,007,662 | 11/1961 | Featheringham | 248/48.2 |
| 3,091,055 | 5/1963 | Hegedusich | 52/11 X |
| 3,972,552 | 8/1976 | Earp, Jr. | 294/19.1 |
| 3,977,135 | 8/1976 | Hunley, Jr. | 52/12 |
| 4,057,276 | 11/1977 | Currie | 294/19.1 |
| 4,199,121 | 4/1980 | Le Febvre | 248/48.2 |
| 4,309,792 | 11/1982 | Faye | 16/389 |
| 4,413,449 | 11/1983 | Faye | 52/16 |

*Primary Examiner*—William F. Pate, III
*Assistant Examiner*—Creighton Smith
*Attorney, Agent, or Firm*—Roy E. Mattern, Jr.

[57] ABSTRACT

Rain gutter supports are provided, whereby leaves, needles, dirt and other debris, are dumped out of conventional rain gutters, by pivoting these rain gutters, upon the initial application of force by hand held tools at ground level, whereby respective spring like holding clips are cleared of the outside top edge of a rain gutter, allowing the rain gutter to be pivoted about a hinge supported lower inside corner.

12 Claims, 5 Drawing Figures

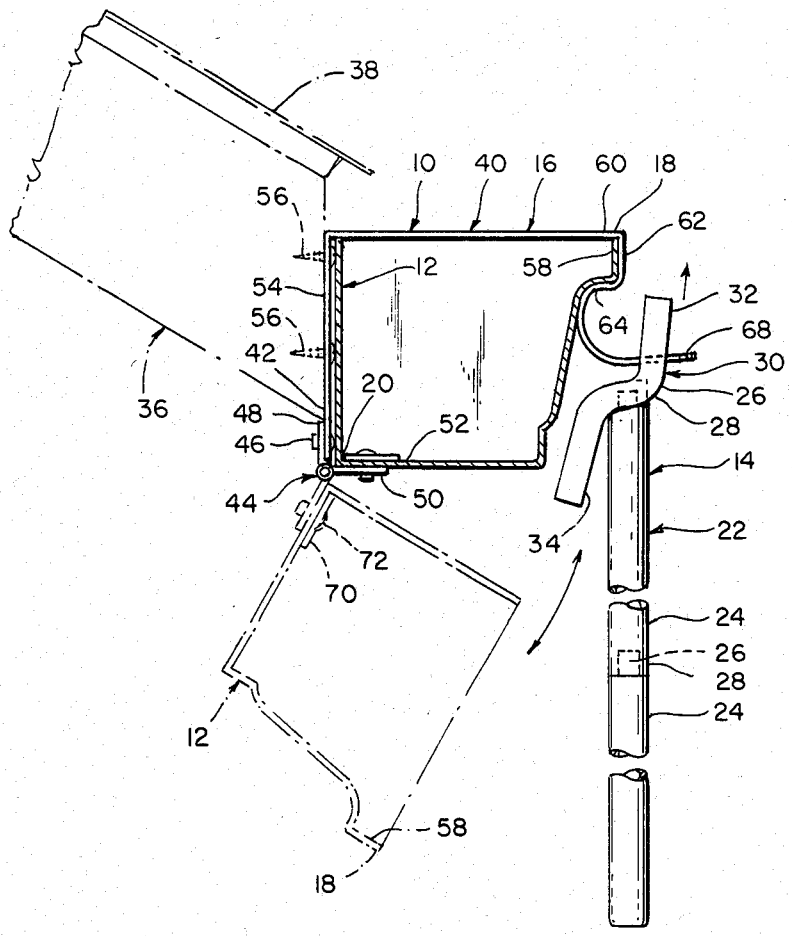
FIG. 3
FIG. 4
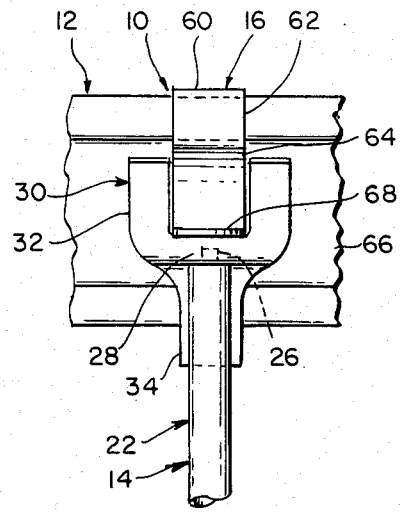
FIG. 5
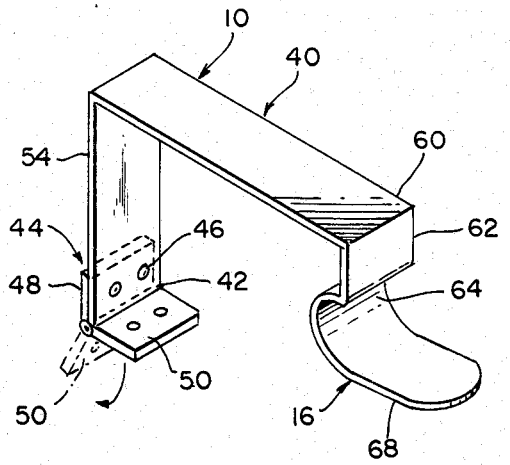

RAIN GUTTER SUPPORTS FOR DUMPING DEBRIS

BACKGROUND

The pivotal movements of rain gutters of dwellings to dump out their contents of leaves, needles and/or dirt has been undertaken previously, as disclosed in U.S. Pat. Nos. such as:

3,091,055 of 1963, wherein Mr. Hegedusich describes his collapsible rain gutter bracket which automatically dumps, when a gutter load is heavy enough to overcome a holding spring;

3,507,078, wherein Mr. Sayers describes his hinges which support a rain gutter, so it may be lifted up and turned upside down for cleaning;

4,117,635 of 1978, wherein Mr. Nelson describes his support brackets and a built in system for rotating and inverting rain gutters, so leaves and debris may be dumped out;

4,199,121 of 1980, wherein Mr. Febvre describes supports for rain gutters, so upon pushing upwardly with a pole against the rain gutters they are inverted and thereby emptied of debris;

4,116,008 of 1978, wherein Mr. Ward describes his rain gutter rotatable mounting, which permits dumping of debris from the gutter. A build in mechanism operable from ground level is used to rotate the rain gutter; and 4,309,792 of 1982, wherein Mr. Faye describes his hinged bracket assemblies which support a rain gutter, so it may be pivoted and inverted to facilitate its cleaning and servicing.

Although for many years there have been illustrations and descriptions of the mounting of rain gutters, so they may be pivotally supported and thereby periodically tilted or inverted, whereby leaves, needles and debris may be dumped, none of these installations are believed to be available today to builders and/or home owners in the Northwest. There remains a need for low cost, reliable, conveniently installed, and easily operated, pivotal supports for rain gutters, so they may be tilted or inverted to dump their collected debris.

SUMMARY

Low cost, reliable, conveniently installed, easily operated rain gutter supports are used to support conventional rain gutters, so they may be tilted periodically to dump leaves, needles, dirt and other debris, by persons standing at ground level, who create releasing forces by conveniently using a hand held tool. These rain gutter supports are spaced similarly to the conventional spike and ferrule supports. At their designated locations, they are secured to structural portions of a dwelling by utilizing an upwardly extending portion of an integral continuous body of the rain gutter support, as fasteners are passed through it and secured to the dwelling.

This upwardly extending portion at its lower end supports a hinge, which in turn supports a portion of the bottom of a rain gutter located adjacent the lower inside corner of the rain gutter, in reference to its cross section, as respective fasteners secure the hinge between the rain gutter support and the rain gutter.

At the upper end of this upwardly extending portion, is an integral spring like clip portion, extending horizontally therefrom, to pass across the rain gutter and releasably hold up the top outside edge of the rain gutter. The end of this spring like clip portion extends over, down, and under the conventional top outside edge of the rain gutter, and preferably, then extends further away from the outside side of the rain gutter, thereby providing a force receiving portion.

The hand held tool, preferably having a selected number of sections to select its operating length, has a top clip contacting portion, preferably having an upstanding U-shaped portion to receive the force receiving portion of the spring like clip portion of the rain gutter support. Also this tool preferably has a depending portion, which is curved downwardly for positioning under the outside side of a rain gutter, to controllably intercept the downwardly pivoting rain gutter, after its release from the spring like clip portion, until it reaches its lowered pivoted debris dumping position. This hand held tool, via this curved depending portion, is used later to reposition the rain gutter into its rain collecting position, as it is again secured by the spring like clip portion and the other cooperating portions of this rain gutter support.

DRAWINGS

The preferred embodiments of this rain gutter support and the hand held tool are illustrated in the drawings, wherein:

FIG. 1 is a perspective view of a portion of a two story dwelling, indicating the spaced placement of these rain gutter supports, and showing a person, who is preparing to manipulate the spring like clip portion thereof, by applying a lifting force by using the special hand held tool, as he or she remains standing at ground level;

FIG. 2 is a perspective view, with portions broken away, to show a conventional rain gutter supported in its rain catching position by the rain gutter support, and to show the top clip contacting portion of the hand held tool, which has both an upstanding U-shaped portion to receive the force receiving portion of the spring like clip portion, and a depending downwardly curving portion for positioning this tool under the outside side of the rain gutter;

FIG. 3 is a side view, with portions broken away, to illustrate via phantom lines, how the rain gutter pivots via a hinge of the rain gutter support, about its lower inside edge, into a debris dumping position, after its release from the spring like clip, undertaken by using the hand held tool, as further indicated by the motion arrows, as the rain gutter support remains secured to the dwelling;

FIG. 4 is a front view with portions broken away, to illustrate the positioning of the top clip contacting portion of the hand held tool, just before the upward lifting force is applied; and FIG. 5 is a perspective view of the rain gutter support, inclusive of its hinge, before it is secured to the dwelling, indicating how the lower hinge plate is free to swing downwardly.

DESCRIPTION OF PREFERRED EMBODIMENTS

Figure 1:
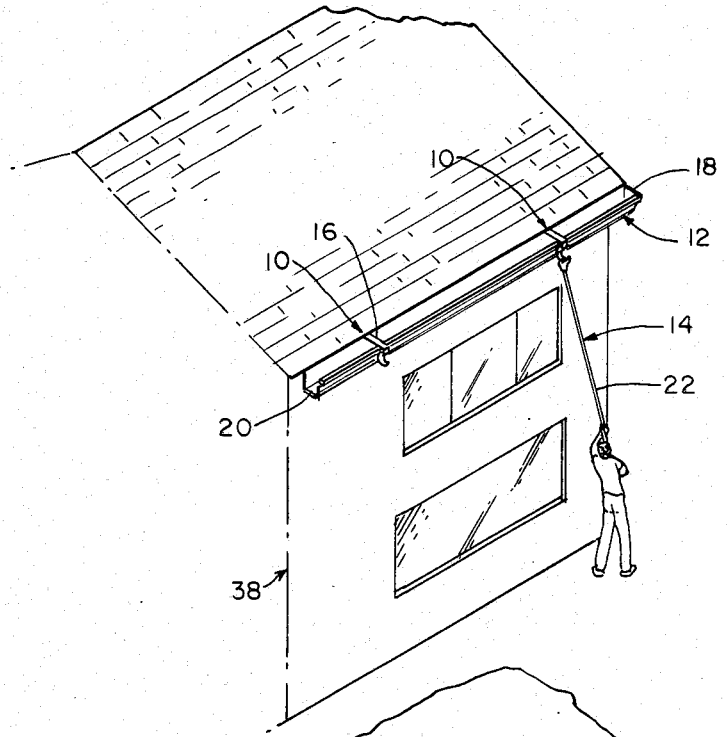
Figure 2:
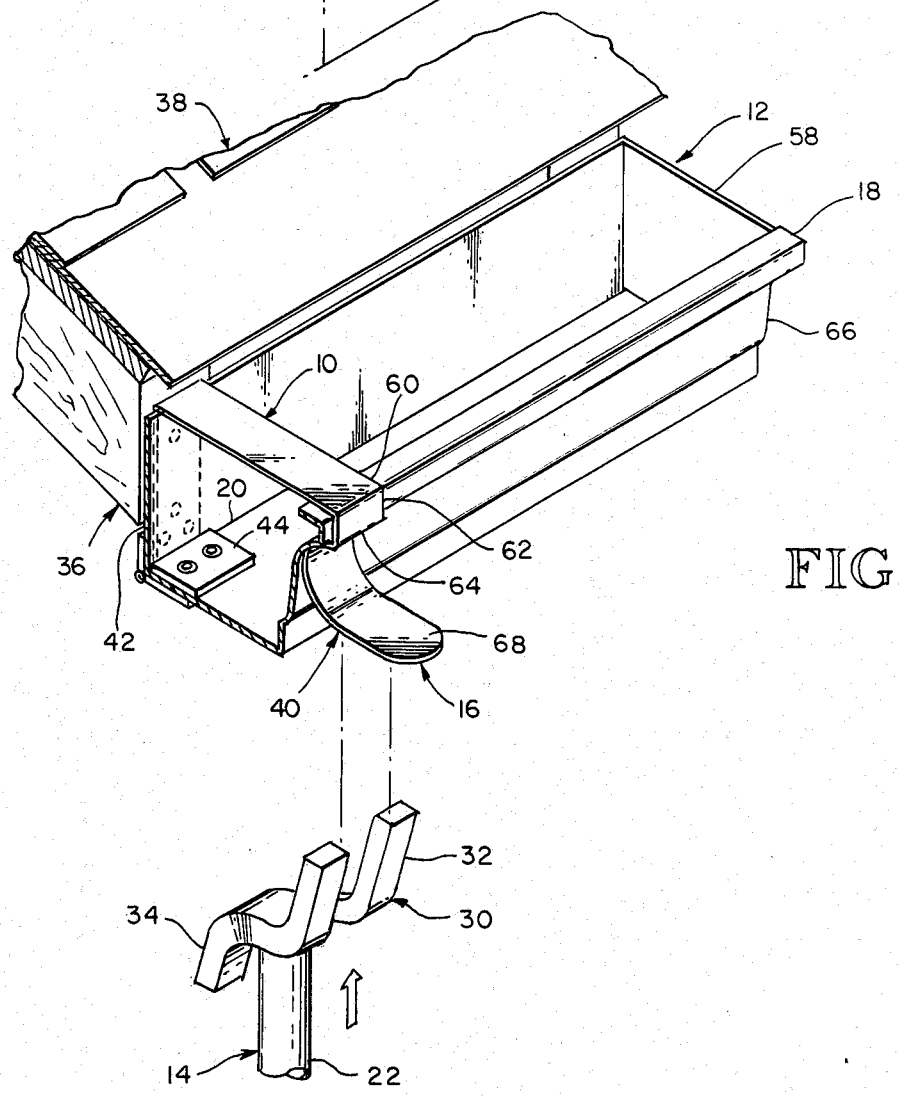

The rain gutter supports 10, which permit dumping of debris from conventional rain gutters 12, and a hand held tool 14, used in releasing a part 16 of these supports to undertake the dumping of debris, are illustrated in their preferred embodiments in the drawings. By providing these rain gutter supports 10 and the hand held tool 14, as shown in FIGS. 1 and 2, a person standing at ground level may manipulate the respective release parts 16 of these supports 10, so the top outside edge 18 of a rain gutter 12 is released, and then the rain gutter 12 swings down pivoting about its lower inside edge 20, as illustrated in FIG. 3, thereby dumping any collected debris down to ground level for its collection. When necessary, when the rain gutter 12 is so positioned and accessible, a water spray (not shown) may be used to continue the cleaning of the interior of the rain gutter 12.

As shown in FIG. 3, the hand held tool 14 preferably has a handle 22 made of a selected number of sections 24, each having a male end fastener 26 and a female end fastener 28, which preferably are threaded together. At the top of the handle 22 is a release part or top clip contacting portion 30, as shown in FIGS. 1, 3 and 4, which has an upstanding U-shaped portion 32 to fit both under and around the release part 16 of the rain gutter support 10. Also this top clip contacting portion 30 of the hand held tool 14 has a downwardly curved portion 34, which is used in guiding the top clip contacting portion 30 into its lifting position. Then, thereafter, upon release of the releasing part 16, this downwardly curved portion 34 is used in supporting the pivoting rain gutter 12, until it completes its tilting into the dumping position, as shown in FIG. 3. Preferably this top clip contacting portion 30 is threadably fastened to the handle 22, by the same male 26 and female 28 type threaded fasteners.

A rain gutter support 10 is illustrated in FIG. 5, as it appears before being secured to the structure 36 of a dwelling 38. It has an integral continuous body 40 having, below, a hinge receiving end 42, to receive a hinge 44, secured by fasteners 46, in respect to one hinge plate 48. The other hinge plate 50 is subsequently secured to the bottom portion 52 of the rain gutter 12, which is located adjacent the lower inside edge 20 of the rain gutter 12, as shown in FIGS. 2 and 3, thereby permitting the downward pivoting of the rain gutter 12, when its top outside edge 18 is released.

This integral continuous body 40, in extending upwardly from the hinge receiving end 42, provides a dwelling structure contacting portion 54, which also serves as a fastener receiving portion, as shown in FIG. 3, in reference to fasteners 56, securing the rain gutter support 10 to the structure 36 of the dwelling 38.

This integral continuous body 40, thereafter extends horizontally from the top of the dwelling structure contacting portion 54, creating a spring like clip portion 16, which serves as the release part 16, as it passes across the open top 58 of the rain gutter 12 to releasably hold up the top outside edge 18 of the rain gutter 12. To so releasably hold the rain gutter 12, the spring like clip portion 16 is formed to extend over 60, down 62, and under 64, a conventional top outside edge 18 of a conventional rain gutter 12.

Thereafter, this spring like clip portion 16 integrally continues to extend out away from the outside side 66 of the rain gutter 12, to thereby provide a force receiving portion 68 of this spring like clip portion 16 of the integral continuous body 40.

This force receiving portion 68 is moved by the clip contacting portion 30 of the hand held tool 14, when the U-shaped portion 32 is positioned, as shown in FIGS. 3 and 4, and a lifting force is applied by a person. After a limited upward movement, the spring like clip portion 16 is cleared from the top outside edge 18 of the rain gutter 12. Then the rain gutter 12, when completely cleared of all such spring like clip portions 16, pivots downwardly, as illustrated in FIG. 3, to thereby dump any leaves, needles, dirt and/or other debris, which had collected in the rain gutter 12.

Although the hinge 44 is shown as a standard hinge, if the production quantities of the rain gutter supports 10 increase, one of the hinge plates 48 could be integrally formed as part of the integral continuous body 40. Also, if non conventional rain gutters 12 are to be made, the integral continuous body 40 would be formed to continue its same functions.

Whenever the material used in the rain gutter 12 is quite thin, it is preferable to use a backing plate 70 secured by fasteners 72, as shown in FIGS. 2 and 3, in securing each hinge plate 50 to the rain gutter 12.

As so manufactured as illustrated in the drawings, or as so modified as described or indicated, these rain gutter supports 12 are available at low cost to be conveniently and economically installed, and to remain reliable to direct the rain water, and when released, to dump the collected leaves, needles, dirt and/or other debris. Moreover, such release, and subsequent securement of the rain gutters 12 is conveniently undertaken by a person standing at ground level using the hand held tool 14, eliminating the dangers related to persons working, while supported on ladders or other temporary supports.

I claim:

1. A rain gutter support adapted to pivotally support a conventional rain gutter, which is conventionally positioned on a dwelling, whereby the rain gutter may be moved to dump its collected debris, upon the application of a reasonable force, via a hand tool, held by a person standing at ground level, comprising:

(a) an integral continuous body having:

below, a hinge receiving end to receive a hinge, which in turn supports a rain gutter, near its inside lower corner edge;

extending upwardly therefrom, a dwelling structure contacting and fastener receiving portion; and extending horizontally therefrom, a spring like clip portion, adapted to pass across a rain gutter and releasably hold up the top outside edge of a rain gutter; and (b) a hinge adapted for securement between the hinge receiving end of the integral continuous body, and a bottom portion of a conventional gutter located adjacent a lower inside corner of a rain gutter.

2. A rain gutter support, as claimed in claim 1, wherein the spring like clip portion is adapted to extend over, down, and under, a conventional top outside edge of a rain gutter.

3. A rain gutter support, as claimed in claim 2, wherein the spring like clip portion is adapted, after extending over, down and under a conventional top outside edge of a rain gutter, to extend out away from the outside side of a rain gutter, thereby providing a force receiving portion of this spring like clip portion.

4. A rain gutter support, as claimed in claim 3, having fasteners to secure the hinge to the hinge receiving portion.

5. A rain gutter support, as claimed in claim 1, wherein the dwelling structure contacting and fastener receiving portion has a lower portion serving as a hinge plate.

6. A rain gutter support, as claimed in claim 4, having additional fasteners to secure the hinge to a conventional rain gutter.

7. A rain gutter support, as claimed in claim 6, having additional fasteners to secure the dwelling structure contacting and fastener receiving portion to the dwelling structure.

8. A rain gutter support, as claimed in claim 1, having a hand held pole, in turn terminating in a top clip contacting portion, to be used in applying upwardly directed forces against the spring like clip portion, to clear this clip portion away from the upper outside edge of a rain gutter, whereby a rain gutter then pivots downwardly about its inside lower edge, which is supported by a hinge.

9. A rain gutter support, as claimed in claim 7, having a hand held pole, in turn terminating in a top clip contacting portion, to be used in applying upwardly directed forces against the spring like clip portion, to clear this clip portion away from the upper outside edge of a rain gutter, whereby a rain gutter then pivots downwardly about its inside lower edge, which is supported by a hinge.

10. A rain gutter support, as claimed in claim 9, wherein the top clip contacting portion of the hand held pole has an upstanding U-shaped portion to receive the force receiving portion of the spring like clip portion.

11. A rain gutter support, as claimed in claim 11, wherein the top clip contacting portion of the hand held pole has a depending portion, which is curved downwardly for positioning under the outside side of a rain gutter, to controllably intercept the downwardly pivoting rain gutter, after its release from the spring like clip portion, until it reaches its lowered pivoted debris dumping position, and later to be used to reposition the rain gutter into its rain collecting position, as it is again secured by the spring like clip portion and the other cooperating portions of this rain gutter support.

12. A rain gutter support, as claimed in claim 12, wherein the hand held pole has multiple interconnectable sections used in adjusting its overall length.

* * * * *